US007909552B2

(12) United States Patent
Maresh et al.

(10) Patent No.: US 7,909,552 B2
(45) Date of Patent: Mar. 22, 2011

(54) ROTATABLE PARTITION SYSTEM FOR A FREIGHT CARRYING ENCLOSURE

(75) Inventors: Mark Edmund Maresh, Wake Forest, NC (US); Eric Allen Stegner, Durham, NC (US); Robert William Stegner, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 653 days.

(21) Appl. No.: 11/782,361

(22) Filed: Jul. 24, 2007

(65) Prior Publication Data

US 2009/0026211 A1 Jan. 29, 2009

(51) Int. Cl.
*B60P 7/08* (2006.01)

(52) U.S. Cl. ..... 410/91; 410/94; 410/121

(58) Field of Classification Search ..... 410/29, 410/31, 32, 89, 90, 91, 94, 95, 120, 121, 410/129, 130, 135, 140, 155; 296/24.44, 296/37.5, 37.6; 224/403, 404, 524, 525, 224/526, 527, 42.34, 543, 549, 564, 565, 224/566

See application file for complete search history.

(56) References Cited

U.S. PATENT DOCUMENTS 5,493,818 A 2/1996 Wilson
5,540,013 A 7/1996 Diamond
5,596,844 A 1/1997 Kalinowski
6,007,283 A * 12/1999 Labeur ..... 410/97
6,732,895 B2 * 5/2004 Poliquin et al.
6,772,567 B2 8/2004 Diffrient, Jr. et al.
6,997,323 B2 2/2006 Maresh et al.
7,117,645 B2 10/2006 Bzorgi
2006/0124500 A1 6/2006 Mena et al.

* cited by examiner

*Primary Examiner* — Stephen Gordon

(74) *Attorney, Agent, or Firm* — Yee & Associates, P.C.; Steven L. Bonnett

(57) ABSTRACT

A flexible system is provided for preventing freight damage during shipment. The system has adjustable and interlocking hinged panels that are attached to the side walls of a shipping enclosure, so that the system can be readily adapted to secure different types and sizes of loads. One embodiment of the invention, provided for use with a freight carrying enclosure that has an internal wall, includes first and second panel segments that each have an edge. A first mounting structure supports the first panel segment for rotation about a vertical axis, between a first position wherein the first panel segment is in perpendicular relationship with the wall, and a second position wherein the first panel segment is in abutting relationship with the wall. A second mounting structure joins the first and second panel segments together along their respective edges, and enables rotation of the second panel between vertical and horizontal orientations. A support structure selectively maintains the second panel segment in its horizontal orientation.

21 Claims, 4 Drawing Sheets

ROTATABLE PARTITION SYSTEM FOR A FREIGHT CARRYING ENCLOSURE

BACKGROUND OF THE INVENTION

1. Field of the Invention

The invention disclosed and claimed herein generally pertains to a flexible system for preventing or minimizing damage caused to freight during shipment. More particularly, the invention pertains to a system of such type for avoiding damage caused by unintended movement of goods or products within a truck trailer, cargo container, or other freight carrying enclosure. Even more particularly, the invention pertains to a system of the above type that prevents freight damage during shipment by utilizing highly adjustable compartmentalization components that can be built into the cargo container or enclosure.

2. Description of the Related Art

It is very common for items of freight to be damaged during shipment, as the result of unintended movements such as shifting, tipping or tumbling. Shifting generally refers to the movement of heavy freight due to forces that can damage or impact other freight. Tipping occurs when a large top heavy load falls over because of inadequate securement, and tumbling is the occurrence of stacked freight falling off of other freight, likewise because of inadequate securement. All these types of movement can affect goods being transported in virtually any kind of shipping container or freight carrying enclosure, including without limitation truck trailers, rail cars, ocean containers, and air cargo containers.

In the past, approaches for securing freight to prevent undesired movements have included use of load bars, strapping, and bracing with wood. However, all these methods of securement have distinct disadvantages. Load bars tend to become loose during shipment, and can damage freight by abrasions or other actions. In addition, load bars can be very prone to theft. Strapping is generally limited to or constrained by the type of trailer that is used, and is a manual process that increases loading time. Strapping can also cause damage to freight. Bracing methods are labor intensive and inconsistent, and tend to be used very differently by different shipping companies.

In providing an improved means and method to secure cargo during shipment, it is important to consider the growing importance of the small parcel environment. Shippers in this environment, such as UPS and Fed Ex, must be able to transport goods and parcels of varying sizes to a range of recipients, including both businesses and individuals. Thus, in an improved solution for cargo securement, it would be very desirable to accommodate larger sized parcels, and at the same protect smaller parcels from being crushed or otherwise damaged. Moreover, it would be of great benefit to enable cargo carrying vans and cargo containers of all types to be easily adapted or customized to accommodate widely varying loads, as well as mixes of parcel sizes that are continually changing.

BRIEF SUMMARY OF THE INVENTION

The invention generally provides a flexible system and method for preventing freight damage during shipment, by utilizing compartmentalization that is built into shipping containers and the like. A system of the invention has adjustable and interlocking hinged panels that are attached to the side walls of a shipping enclosure, so that the system can be readily adapted to secure different types and sizes of loads. The risk of shifting, tipping or tumbling of freight in the enclosure is thereby reduced significantly. One embodiment of the invention, directed to a rotatable partition system for use with a freight carrying enclosure that has an internal wall, includes a first panel segment having an edge, and a second panel segment that likewise has an edge. A first mounting structure is joined to support the first panel segment for rotation about a vertical axis, between a first position wherein the first panel segment is in perpendicular relationship with the wall, and a second position wherein the first panel segment is in abutting relationship with the wall. The system further includes a second mounting structure that joins the first and second panel segments together along their respective edges, and enables rotation of the second panel, with respect to the first panel segment, between vertical and horizontal orientations. A support structure is additionally provided, for selectively maintaining the second panel segment in its horizontal orientation.

BRIEF DESCRIPTION OF THE SEVERAL VIEWS OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
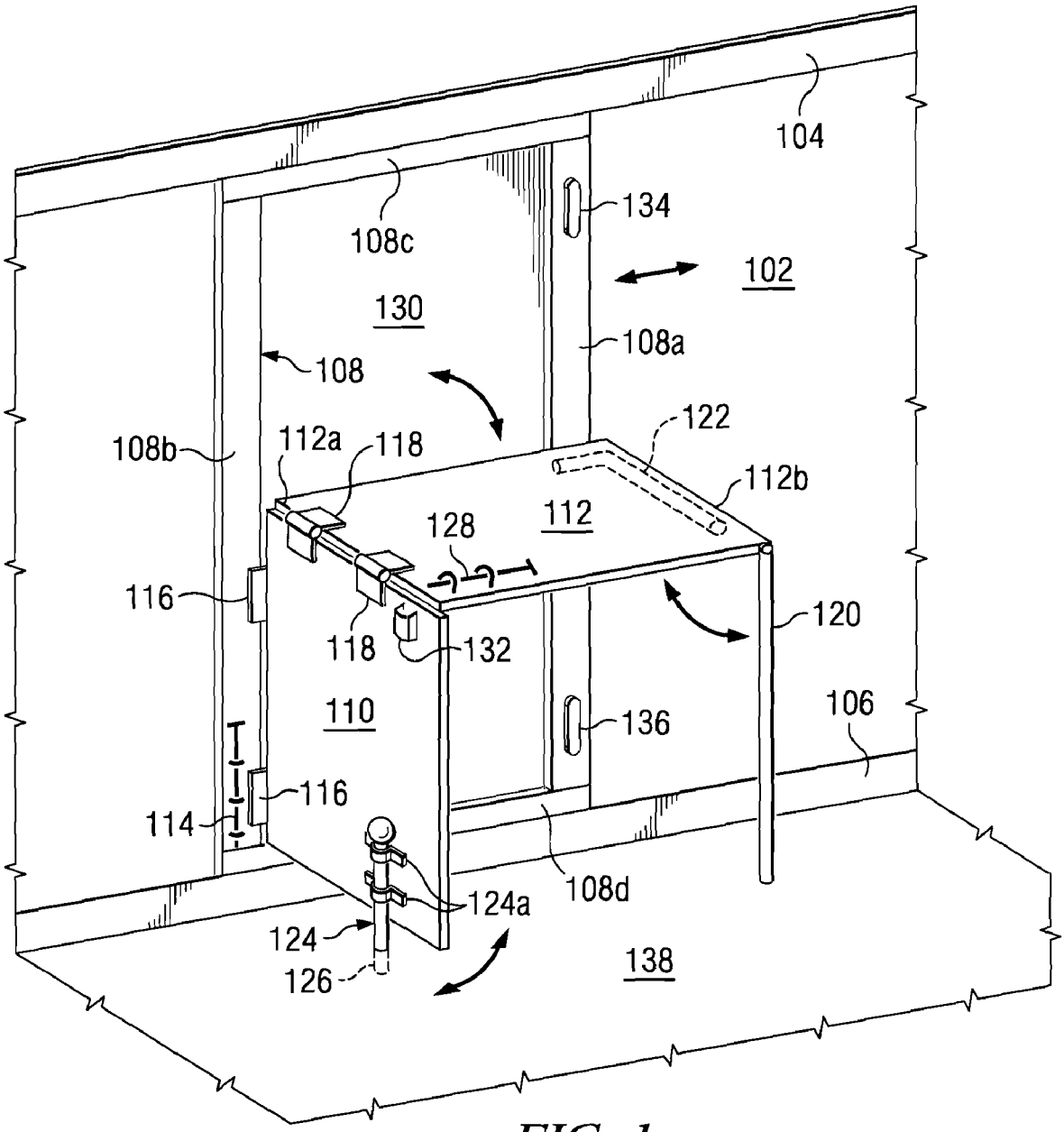
FIG. 1 is a perspective view showing respective components for an embodiment of the invention.

Referring to FIG. 1, there is shown an interior wall 102 of an enclosure for holding and carrying freight of various kinds. The enclosure can be, without limitation, a cargo carrying truck trailer or van, a rail car or other type of cargo container. Two rails 104 and 106 are fixably attached to interior wall 102, in a horizontal orientation and in spaced apart relationship with one another. A frame 108 is mounted upon rails 104 and 106, for slidable motion therealong in a horizontal direction, that is, motion either to the left or right as viewed in FIG. 1. Frame 108 comprises side members 108*a* and 108*b*, and top and bottom members 108*c* and 108*d*, respectively.

While not shown, top frame member 108*c* is provided with rollers or other conventional mechanisms for engaging rail 104, such as in a groove thereof (not shown), in order to allow easy travel of top member 108*c* along rail 104. Bottom member 108*d* is likewise provided with such rollers or other conventional mechanisms (not shown), to allow easy travel of member 108*d* along rail 106. Thus, frame 108 can be moved along rails 104 and 106 with a minimal amount of manual effort, over a pre-specified path of travel. The path of travel could comprise the entire length of wall 102, or alternatively could be limited to a selected section thereof.

FIG. 1 also shows frame 108 provided with a locking mechanism, such as a pin or plunger 114. When frame 108 has been moved to a selected position, pin 114 may be inserted into one of a series of complementary holes (not shown) located along rail 106 to retain frame 108 at the selected position.

Figure 2:
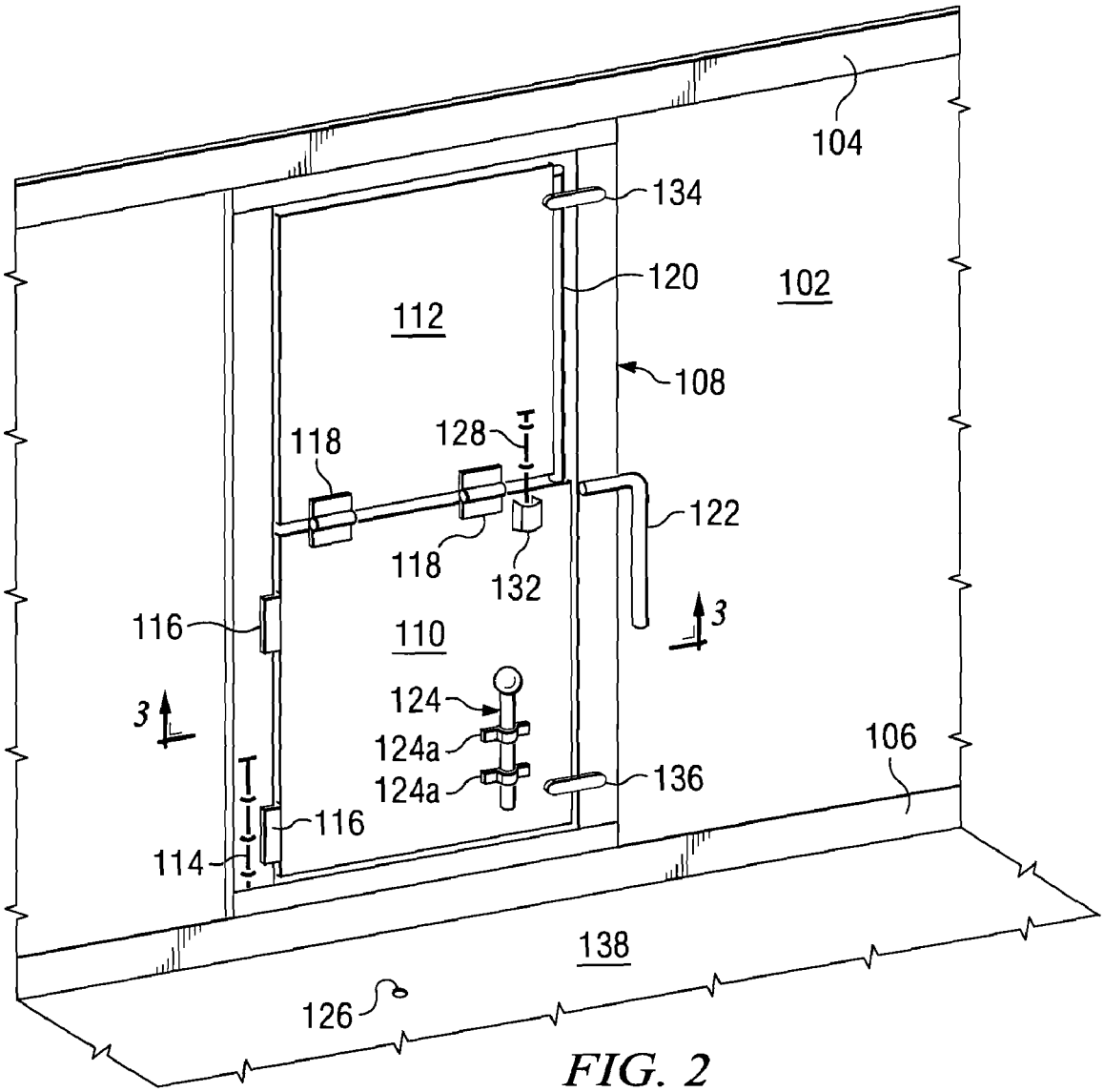
FIG. 2 is a perspective view showing panel segments of the embodiment of FIG. 1 moved into a recess defined by the frame of such embodiment.

Referring further to FIG. 1, there is shown a lower panel segment 110, joined to frame 108 by means of hinges 116 or the like. Hinges 116 support lower panel 110 for rotational or pivotal movement with respect to frame 108, about a vertical axis. More particularly, lower panel segment 110 is supported for rotation between a position wherein it is in perpendicular relationship with wall 102, as shown in FIG. 1, and a position wherein lower panel 110 is in abutting or closely spaced relationship with wall 102, as shown in FIG. 2. In this latter position, lower panel 110 is moved into a recessed space or recess defined by frame 108, as discussed hereinafter in connection with FIG. 2.

FIG. 1 further shows an upper panel segment 112 having an edge 112*a* that is joined to the upper edge of lower panel 110 by means of hinges 118 or the like. Upper panel 112 can thereby be pivoted or rotated with respect to lower panel 110, about a horizontal axis. More particularly, upper panel 112 can be rotated between a horizontal orientation as shown in FIG. 1, and a vertical orientation as shown in FIG. 2, described hereinafter.

By supporting upper panel segment 112 in the horizontal mode shown in FIG. 1, the upper panel can provide a convenient shelf for carrying parcels or other goods. Upper panel segment 112 also acts to protect goods that are stored under it, such as from other goods that fall from a higher location in the freight carrying enclosure. In one useful embodiment, upper panel 110 could be supported at approximately one-half the distance from the floor to the ceiling of the freight enclosure, so that load carrying pallets that were "half high" (not shown) could be placed under upper panel segment 112.

In the horizontal mode shown in FIG. 1, upper panel 112 and freight carried thereby is supported in part by lower panel 110, attached to frame 108. Upper panel 110 can be further supported, proximate to edge 112*b* thereof that opposes edge 112*a*, by means of a bracket 122 attached to side member 108*a* of frame 108. Bracket 122 can usefully be pivoted to a horizontal position, and locked therein to support upper panel 112 as shown in FIG. 1. Bracket 122 can also be pivoted downward to a vertical position when not needed, so that it may be kept out of the way. Alternatively, or in addition, a rotational or pivotable leg 120 may be attached proximate to edge 112*b* of upper panel 112. The leg would be rotated into the position shown in FIG. 1, in order to support panel 112 and goods carried thereon in a horizontal mode.

It will be understood that various other means besides those shown, which are well known by those of skill in the art and are within the scope of the invention, may alternatively be employed to support upper panel 112 in its horizontal position. In a further configuration described hereinafter in connection with FIG. 4, a panel segment similar to lower panel 110, and attached to another slidable frame 108, is positioned so that its upper edge can receive and support edge 112*b* of upper panel segment 112.

FIG. 1 further shows a locking pin 124 or similar device slidably attached to lower panel segment 110, by means of brackets 124*a* or the like. When frame 108 is held in a prespecified position by means of pin 114 as described above, locking pin 124 is aligned with a well or socket 126, when lower panel 110 is moved to its perpendicular position as shown by FIG. 1. Thereupon, pin 124 is moved downward into socket 126, to lock lower panel 110 into the perpendicular position, and to thereby provide rigid support for upper panel 112. Socket 126 is formed in the floor 138 of the freight enclosure.

As is further shown by FIG. 1, a pin 128 mounted on upper panel segment 112 is positioned in complementary relationship with a socket structure, or other device 132, that is mounted on lower panel segment 110. Thus, when the upper panel is rotated into its vertical position, pin 128 can be inserted into socket structure 132. The two panel segments are thereby firmly joined together, to form a full or complete panel. The members 108*a-d* of frame 108 collectively define a recess 130 adjacent to wall 102. This recess is sized to receive the full panel, when panel segment 112 is in its vertical mode, and panel segment 110 is rotated into abutting relationship with wall 102. Latches 134 and 136 are mounted on frame 108, for use in retaining the full panel in recess 130. Panel segments 110 and 112 respectively comprise flat, thin rectangular members formed of suitable material, such as wood, wire mesh, metal, or composite.

Figure 3:
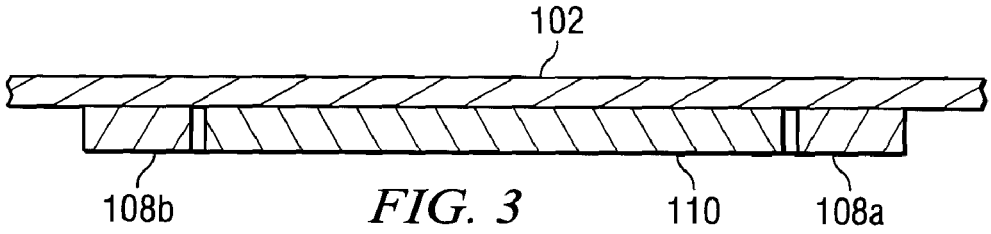
FIG. 3 is a sectional view taken along lines 3-3 of FIG. 2.

Referring to FIG. 2, there are shown both panel segments 110 and 112 vertically oriented and rotated into recess 130, in abutting relationship with wall 102. Latches 132 and 134 are set to firmly retain the panel segments in the recess. A sectional view provided by FIG. 3 indicates that the thickness of panel segments 110 and 112 is substantially the same as the thickness of the members 108*a-d* that respectively form frame 108. As a result, when the full panel comprising both segments is moved into recess 130, the panel is flush with frame 108, and thus does not obstruct or interfere with activity in the freight carrying enclosure.

It will be seen that the system components shown by FIGS. 1 and 2 provide a high degree of flexibility. The sliding frame 108 allows the panel segments to be located at a range of positions along the length of the enclosure. Thus, as further described hereinafter, one or both panel segments can be used to secure loads of varying lengths. Upper panel segment 112, when in a horizontal mode, provides a very useful shelf for carrying smaller sized goods, and thus has great utility in a small parcel environment. To accommodate large sized freight, both panels can be moved into the recess 130, and thus kept out of the way. As a further benefit, existing cargo carrying vehicles and containers can be readily retrofitted with the respective components needed for embodiments of the invention.

Figure 4:
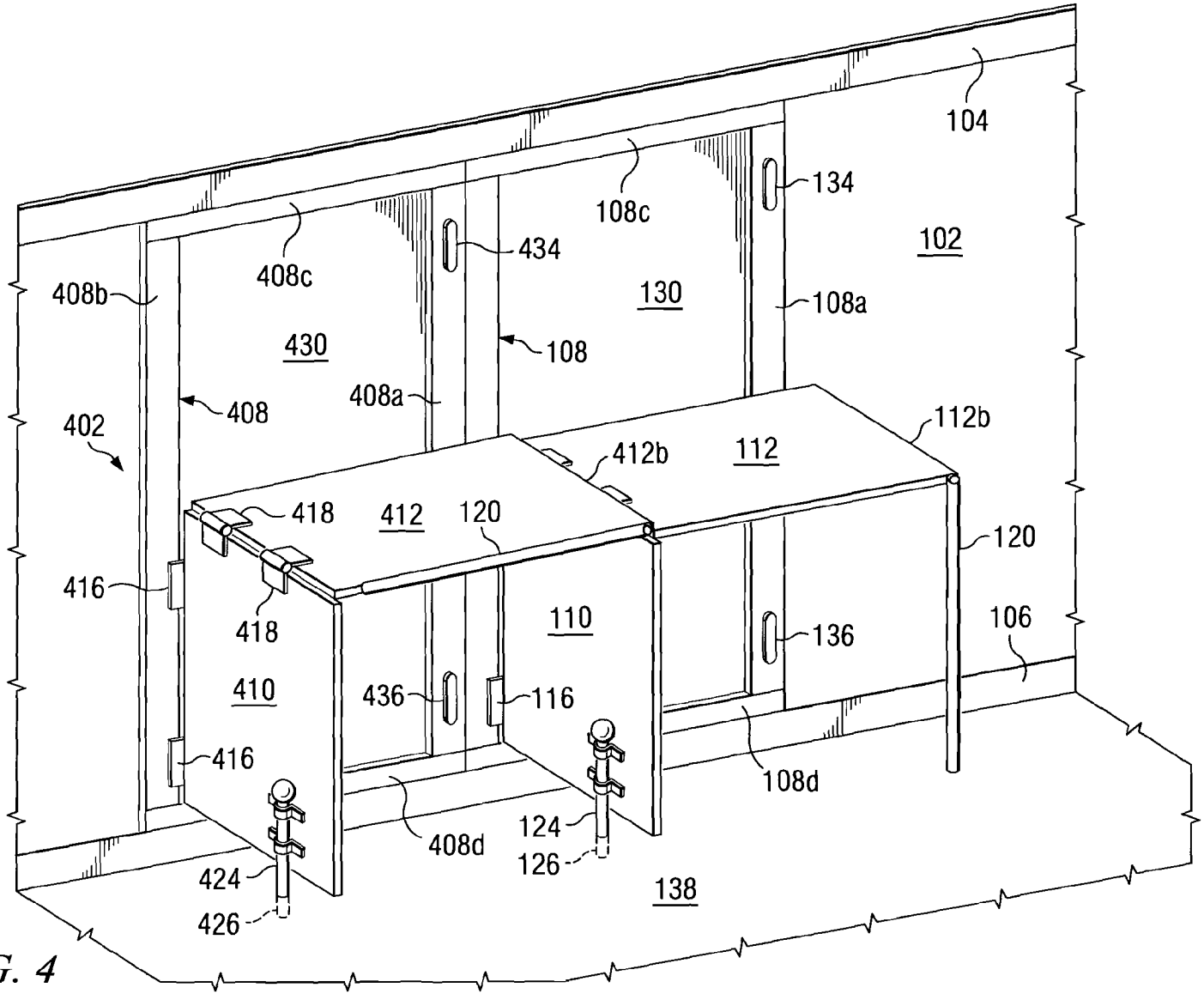
FIG. 4 is a perspective view depicting multiple panel configurations of the type shown in FIG. 1.

Referring to FIG. 4, there is shown the partitioning configuration of FIG. 1 together with a similar configuration 402, which comprises a slidable frame 408, a lower panel segment 410 and an upper panel segment 412. Components of configuration 402 are similar or identical to the respectively corresponding components of the FIG. 1 configuration. Thus, frame 408 is substantially similar to frame 108, and is mounted for slidable movements along rails 104 and 106. Frame 408 comprises members 408*a-d*, corresponding to members 108*a-d*, respectively, of frame 108. Panel segments 410 and 412 are similar to segments 110 and 112, respectively, and are similarly connected to one another and to frame 408. Components 416-418, 424-426 and 434-436 have substantially the same forms and functions as components 116-118, 124-126 and 134-136, respectively. In one useful implementation, all the latches 134-136 and 434-436 are respectively recessed, to avoid being an obstruction or interference when the corresponding panels are received into recesses 130 and 430 of the frames 108 and 408.

Referring further to FIG. 4, there is shown upper panel 112 supported by foldable leg 120 as described above. However, upper panel 412 is not provided with a foldable leg. Instead, frame 408 is moved along rails 104 and 106 to position the edge 412*b* of upper panel 412 upon edge 112*a* of upper panel 112, and on the upper edge of lower panel 110. Thus, panel segment 412 is supported in its horizontal mode by the combined action of lower panel segments 110 and 410.

While FIG. 4 shows only two partitioning configurations, it is to be understood that any reasonable number of configurations 402 could be located along wall 102*b*, in spaced relationship with one another, to form an array. Each upper panel 412 would be supported in its horizontal mode by the lower panel segment 112 immediately to its right, as viewed in FIG. 4. Only the upper panel segment at the end of the array would require other support, such as leg 120 or bracket 122 as described above.

Usefully, each upper panel 412 is also provided with a support member such as leg 120. A panel 412 can then be supported independently of an adjacent lower panel 110, if desired.

In yet another embodiment of the invention, one or more frames 408 could be fixably attached to wall 102, so that they were not horizontally movable, while one or more other frames 108 or 408 were allowed to move horizontally. This could further enhance the adaptability of the system disclosed herein.

Figure 5A:
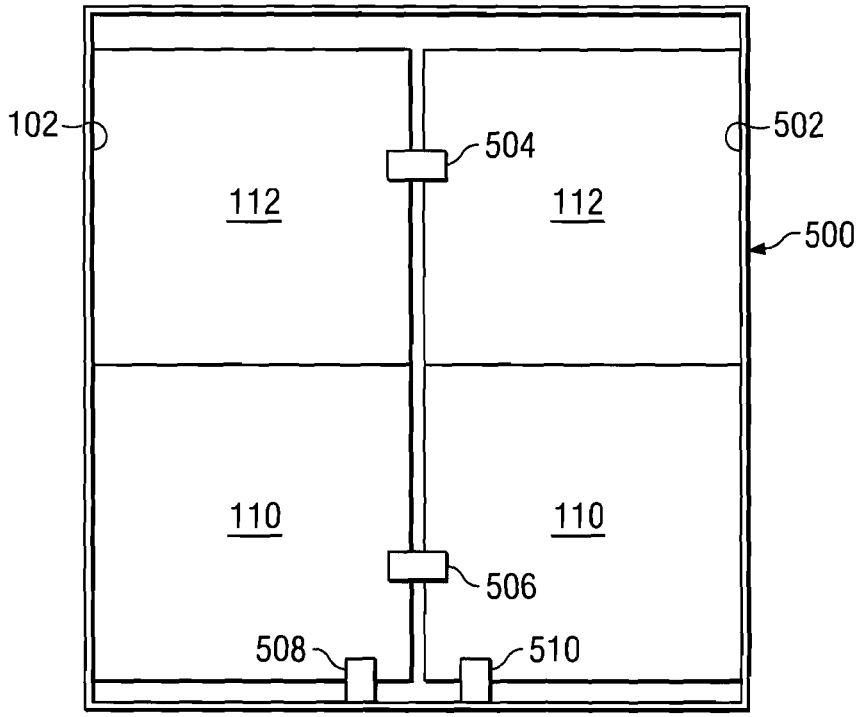
FIGS. 5A and 5B are schematic views showing two respective modes of use of an embodiment of the invention.

Referring to FIG. 5A, there are shown two of the configurations as shown by FIG. 1, respectively mounted to opposing internal walls 102 and 502 of a freight carrying enclosure 500. To secure a load of a particular length, each of the upper panels 112 is rotated to its vertical position, and the two configurations are moved the same distance along the walls 102 and 502, wherein such distance is equal to the particular load length. The two panels 110 are thus brought into closely spaced relationship, and are joined together with a latch 506. The two upper panels 112 are similarly placed in closely spaced relationship, and joined by a latch 504. Latches 508 and 510 are further provided, to secure the lower edges of the two full panels.

Figure 5B:
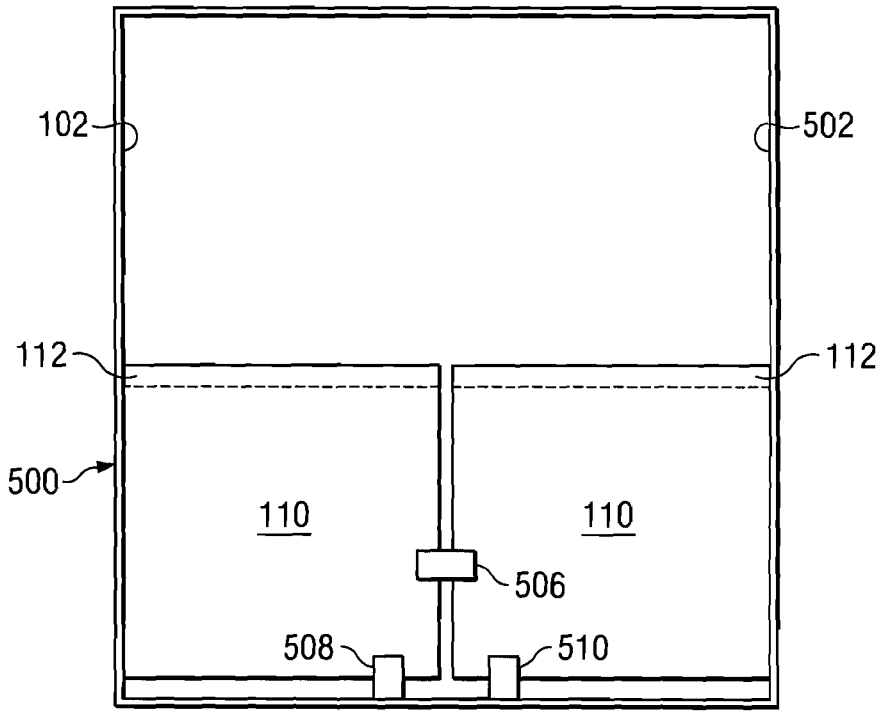

FIG. 5B shows an arrangement similar to that of FIG. 5A, except that the two upper panel segments 112 are rotated to their horizontal positions. This may be done to accommodate a load of reduced height, or to provide shelves as described above.

Embodiments of the invention described above show the lower segment 110 attached to a slidable frame, for rotation about a vertical axis, with upper panel segment 112 being rotatably supported on the upper edge of the panel segment 110. However, in other embodiments of the invention, the upper panel segment could be attached to the slidable frame, for rotation about a vertical axis. A lower panel segment would then be rotatably supported on the lower edge of such upper panel segment, for rotation between horizontal and vertical positions.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A rotatable partition system for use with a freight carrying enclosure having an internal wall, said partition system comprising:

a first panel segment having an edge;

a first mounting structure joined to support said first panel segment for rotation about a vertical axis, between a first position wherein said first panel segment is in substantially perpendicular relationship with said wall, and a second position wherein said first panel segment is in abutting relationship with said wall;

a second panel segment having an edge;

a second mounting structure joining said first and second panel segments together along their respective edges, and enabling rotation of said second panel segment between vertical and horizontal orientations with respect to said first panel segment, wherein said second panel segment is mounted above said first panel segment; and a support structure for selectively maintaining said second panel segment in its horizontal orientation, wherein the support structure extends between the second panel segment and a floor, wherein the floor is located below the second panel segment in a spaced apart relationship with the second panel segment.

2. The system of claim 1, wherein said first mounting structure comprises:

one or more horizontally oriented rails fixably mounted to said wall;

a slidable frame mounted for selected horizontal movements along said one or more rails; and a hinge mechanism extending between said slidable frame and a side of said first panel segment, in order to support said first panel segment for rotation about said vertical axis.

3. The system of claim 1, wherein:

said second mounting structure comprises a hinge mechanism that engages the edges of said first and second panel segments, said hinge mechanism being operable to transfer a first force from said first panel segment to said second panel segment when said second panel segment is in a horizontal orientation.

4. The system of claim 3, wherein:

said support structure comprises a support mechanism for applying a second force to said second panel segment, proximate to an edge that opposes the edge of said second panel segment which is engaged by said hinge mechanism, wherein said second force cooperatively acts with said first force to maintain said second panel segment in a horizontal orientation, and to carry a load of specified weight placed upon the second panel segment.

5. The system of claim 4, wherein:

said support mechanism comprises a bracket supported by a frame.

6. The system of claim 4, wherein:

said support mechanism comprises a foldable leg attached to said second panel segment.

7. The system of claim 4, wherein:

said second mounting structure comprises a first additional segment that is substantially identical to said first panel segment, wherein said first additional segment is spaced along said wall from said first panel segment to selectively receive and support said second panel segment.

8. The system of claim 1, wherein:

a frame defines a recess sized to receive both said first and second panel segments, when said second panel segment is rotated to its vertical orientation, and said first panel segment is in said abutting relationship with said wall.

9. The system of claim 1, wherein:

the edge of said first panel segment is positioned above the floor at a distance that is slightly greater than a height of a pallet of prespecified size.

10. The system of claim 1, wherein:

said first panel segment comprises a lower panel segment having an upper edge, and said second panel segment comprises an upper panel segment joined to said lower panel segment along said upper edge thereof.

11. The system of claim 1, wherein:

said first panel segment comprises an upper panel segment having a lower edge, and said second panel segment comprises a lower panel segment joined to said upper panel segment along said lower edge thereof.

12. The system of claim 1, wherein:

said rotatable partition system comprises a first rotatable system, and said internal wall comprises a first internal wall in opposing relationship with a second internal wall of said enclosure, wherein a second rotatable partition system that is substantially similar to said first rotatable partition system is mounted to said second internal wall for selected horizontal movements therealong.

13. A rotatable partition system for use with a freight carrying enclosure having an internal wall, said partition system comprising:

a first panel segment having an edge;

a first mounting structure joined to support said first panel segment for rotation about a vertical axis, between a first position wherein said first panel segment is in substantially perpendicular relationship with said wall, and a second position wherein said first panel segment is in abutting relationship with said wall, wherein said first mounting structure comprises:

one or more horizontally oriented rails fixably mounted to said wall;

a slidable frame mounted for selected horizontal movements along said one or more rails; and a hinge mechanism extending between said slidable frame and a side of said first panel segment, in order to support said first panel segment for rotation about said vertical axis;

a second panel segment having an edge;

a second mounting structure joining said first and second panel segments together along their respective edges, and enabling rotation of said second panel segment between vertical and horizontal orientations with respect to said first panel segment; and a support structure for selectively maintaining said second panel segment in its horizontal orientation.

14. The system of claim 13, wherein:

said second mounting structure comprises a hinge mechanism that engages the edges of said first and second panel segments, said second mounting structure hinge mechanism being operable to transfer a first force from said first panel segment to said second panel segment when said second panel segment is in a horizontal orientation.

15. The system of claim 14, wherein:

said support structure comprises a support mechanism for applying a second force to said second panel segment, proximate to an edge that opposes the edge of said second panel segment which is engaged by said hinge mechanism, wherein said second force cooperatively acts with said first force to maintain said second panel segment in a horizontal orientation, and to carry a load of specified weight placed upon the second panel segment.

16. The system of claim 15, wherein:

said support mechanism comprises a bracket supported by a frame.

17. The system of claim 15, wherein:

said support mechanism comprises a foldable leg attached to said second panel segment.

18. The system of claim 13, wherein:

a frame defines a recess sized to receive both said first and second panel segments, when said second panel segment is rotated to its vertical orientation, and said first panel segment is in said abutting relationship with said wall.

19. The system of claim 13, wherein:

the edge of said first panel segment is positioned above a floor of the freight carrying enclosure at a distance that is slightly greater than a height of a pallet of prespecified size.

20. The system of claim 13, wherein:

said first panel segment comprises a lower panel segment having an upper edge, and said second panel segment comprises an upper panel segment joined to said lower panel segment along said upper edge thereof.

21. The system of claim 13, wherein:

said first panel segment comprises an upper panel segment having a lower edge, and said second panel segment comprises a lower panel segment joined to said upper panel segment along said lower edge thereof.

* * * * *